US005804092A

United States Patent [19]

Axelson et al.

[11] Patent Number: 5,804,092

[45] Date of Patent: Sep. 8, 1998

[54] MODULAR CERAMIC IGNITER WITH METALLIZED COATINGS ON THE END PORTIONS THEREOF AND ASSOCIATED TERMINAL SOCKET

[75] Inventors: Scott R. Axelson, Milford, N.H.; Thomas E. Salzer, Bedord, Mass.

[73] Assignee: Saint-Gobain/Norton Industrial Ceramics Corporation, Worcester, Mass.

[21] Appl. No.: 454,760

[22] Filed: May 31, 1995

[51] Int. Cl.[6] ..... F23Q 7/22; H05B 3/08; H01C 1/012

[52] U.S. Cl. ..... 219/270; 219/541; 338/290; 338/312; 338/327

[58] Field of Search ..... 219/260–270, 219/552, 553, 541; 338/326, 327, 318, 290, 311–313; 431/132; 361/264–266; 123/145 A

[56] References Cited

U.S. PATENT DOCUMENTS

| | | | |
|---|---|---|---|
| 2,003,625 | 6/1935 | Boyer | 338/331 |
| 2,095,253 | 10/1937 | Heyroth | 219/270 |
| 2,879,364 | 3/1959 | Mucher | 337/208 |
| 3,167,736 | 1/1965 | Temple | 219/541 |
| 3,345,448 | 10/1967 | Malkin | 338/311 |
| 3,662,222 | 5/1972 | Ray | 439/430 |
| 3,875,476 | 4/1975 | Crandall et al. | 219/553 |
| 3,964,943 | 6/1976 | Andersen | 338/322 |
| 4,176,903 | 12/1979 | Cairo et al. | 219/270 |
| 4,357,526 | 11/1982 | Yamamoto et al. | 219/544 |
| 4,555,358 | 11/1985 | Matsushita et al. | 219/553 |
| 5,045,237 | 9/1991 | Washburn | 219/270 |
| 5,191,508 | 3/1993 | Axelson et al. | 361/264 |
| 5,471,032 | 11/1995 | Spellman et al. | 219/270 |

FOREIGN PATENT DOCUMENTS

| | | | |
|---|---|---|---|
| 486009 | 5/1992 | European Pat. Off. | 219/270 |
| 7-167435 | 7/1995 | Japan . | |
| 2095959 | 10/1982 | United Kingdom | 219/270 |

*Primary Examiner*—Mark H. Paschall
*Assistant Examiner*—Raphael Valencia
*Attorney, Agent, or Firm*—Thomas M. DiMauro

[57] ABSTRACT

A modular igniter system which preferably provides either direct electrical connection between the metallized ends of the hot surface igniter and the socket contact, or indirect electrical connection by a short lead wire held in place on the hot surface element by an active metal braze.

39 Claims, 1 Drawing Sheet

MODULAR CERAMIC IGNITER WITH METALLIZED COATINGS ON THE END PORTIONS THEREOF AND ASSOCIATED TERMINAL SOCKET

BACKGROUND OF THE INVENTION

Ceramic materials have enjoyed great success as igniters in gas fired furnaces, stoves and clothes dryers. A ceramic igniter typically contains conductive end portions and a highly resistive middle portion. When the igniter ends are connected to electrical leads and a current is run through the igniter, the highly resistive portion rises in temperature.

In conventional igniter systems, the electrical circuit is typically formed by connecting the metallized coatings B which cover the ends of a ceramic hot surface element C to the silver solder-coated ends AG of nickel clad copper (NCC) wires L which lead to a socket S or other electrical connection. See FIG. 1.

Although this system is suitable for many igniter applications, its design does engender some problems. For example, when it is determined the ceramic hot surface element C must be replaced, the repair technician must disconnect the igniter at the interface between the NCC lead wire L and the socket S, and then introduce a new igniter at the same interface. Because the NCC lead wire is often at least 12 inches (and sometimes over 36 inches) in length, the situs of the lead wire/socket interface is often far removed from the service position of the hot surface element C, and is typically in a less accessible place. Since this interface is remote, the technician often expends considerable time and effort merely removing and replacing the failed igniter.

In addition, use of conventional igniter designs has become problematic at higher service temperatures. In particular, it has been observed that the NCC wire begins to degrade at about 450° C. (the maximum service temperature of appliance grade wire) and the silver solder becomes liquid at about 600° C. Moreover, the thermal expansion coefficient of NCC wire is so much greater than that of the typical ceramic that it promotes cracking in the ceramic at temperatures starting at about 450° C. Since these phenomena become common when the igniter system is used in an application exceeding about 450° C., use of this conventional igniter system is generally limited to applications having a service temperature lower than 450° C. Accordingly, use of the above design is precluded in many potential applications (such as self-cleaning ranges) which operate above 485° C.

Therefore, there is a need for a high temperature-resistant igniter system which also provides for easy access by a repair technician.

SUMMARY OF THE INVENTION

In accordance with the present invention, there is provided a modular igniter system comprising:

a) a ceramic igniter comprising:
   i) a ceramic hot surface element comprising first and second ends, and
   ii) a metallized coating which covers at least a portion of each end of the ceramic hot surface element; and b) a socket comprising first and second contacts which are in electrical connection with the metallized coatings of the igniter, wherein the contacts have a melting point of at least 485° C.

Also in accordance with the present invention, there is provided a metallized coating for use in bonding ceramic igniters to electrical contacts or leads, the metallized coating comprising:

a) a first layer selected from the group consisting of titanium, zirconium and mixtures thereof, and having a thickness of between about 1000 and 10,000 angstroms, b) a second layer selected from the group consisting of molybdenum, tungsten, tantalum, columbium and mixtures thereof, and having a thickness of between about 2000 and 20,000 angstroms, and c) a third layer selected from the group consisting of nickel, chromium, silver, gold, platinum, palladium, manganese and mixtures thereof, and having a thickness of between about 10,000 and 100,000 angstroms.

DETAILED DESCRIPTION OF THE INVENTION

Figure 1:
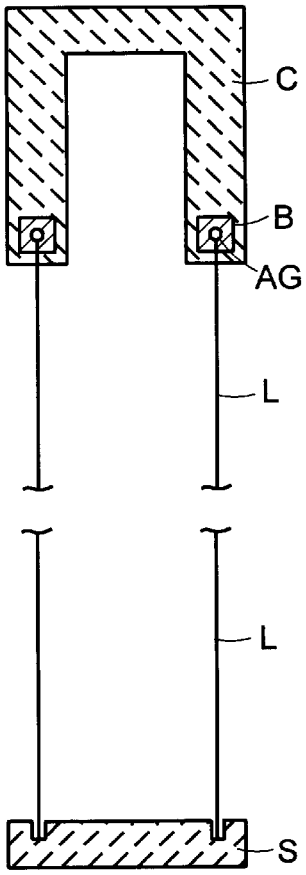
FIG. 1 PRIOR ART
FIG. 1 is a drawing of a prior art igniter system for smaller hot surface elements which contain silver solder and nickel clad copper wire.

Simply substituting a conventional high temperature lead wire (such as 18 gauge Ni—Cr wire) for the silver solder-tipped NCC lead wire was considered by the present inventor. Although this high temperature lead wire bonds well to conventional metallized coatings and would likely withstand the high temperatures surrounding the igniter, it is also very expensive. Moreover, the extreme rigidity of the Ni—Cr wire imparts significant stress on the hot surface element, leading to igniter failure. Lastly, since the distance between the hot surface element and the socket in conventional systems is often quite long, simple substitution would result in an expensive igniter system prone to disconnection. Accordingly, further modification of the conventional system was pursued.

The present invention has overcome the drawbacks of the conventional NCC wire-based system by either:

a) plugging ends of the hot surface element directly into a socket having high temperature metal contacts (and which is located next to the service position of the hot surface element) so that the metallized coatings covering the ends of the hot surface element make direct electrical connection with the high temperature metal contacts of the socket, or b) electrically connecting the hot surface element to the high temperature contacts of a socket (which is again located next to the service position of the hot surface element) through a pair of short, high temperature wires.

In each of these systems, there is no longer an easily degradable material (e.g., NCC wire or low temperature contact) near the hot surface element. The high temperature contacts of the socket can then be connected to NCC wire (not shown) on the opposite side of the socket, where the more moderate temperatures (i.e., about 450° C.) do not threaten the integrity of the NCC wire. Moreover, since the socket is now close to the igniter, both the plug and the short, high temperature wire embodiments provide a "modular"

igniter which can be disconnected from its socket at the situs of the hot surface element, thereby allowing its easy original installation or replacement.

The socket of the present invention can be any conventional socket used in the igniter field which can provide an electrical circuit through the ceramic hot surface element (either directly or through an intermediate wire) and maintain its integrity when exposed to temperatures of at least 485° C., preferably at least 650° C. Typically, the socket contains two parallel grooves which extend into the socket for reception of either the igniter ends or the high temperature wire. In some preferred embodiments wherein the ends of the hot surface element are plugged into the socket, the grooves are large enough to securely receive the entire ends of the hot surface element and further contain pad-like high temperature contacts which are positioned on the sidewalls of the groove for direct electrical connection with the metallized coatings of the igniter. In other preferred embodiments utilizing high temperature lead wires, the grooves are appropriately shaped for reception of the short high temperature wires and contain high temperature contacts shaped as tubes for direct reception of and connection to the high temperature wires. Materials suitable for use as a socket substrate include cordierite. On the face of the socket opposite its grooves, the socket usually possesses electrical ports which are in electrical connection with the high temperature contacts. These ports provide a means of electrically connecting the high temperature contacts to an NCC lead wire in a less extreme environment.

The contacts of the present invention can be any high temperature material which can conduct a current and resist degradation up to a temperature of no less than 485 C., preferably no less than 650° C. Typically, the contacts are made of metal or a metal alloy. Some materials suitable for use as the contact include nickel alloys, nickel, gold, silver and platinum. The size and shape of the contacts depend upon the type of electrical connection desired. For example, the contacts can be shaped as flat pads and positioned along the sidewalls of a groove in the socket (if direct connection to the metallized coating of the hot surface element is desired), or as tubes which essentially line the groove (if indirect connection to the metallized coatings through a high temperature lead wire is desired). In some embodiments, the contacts can comprise a spring metal base having a noble metal-type coating.

The ceramic hot surface element of the present invention can be made of any ceramic typically used in the igniter field, including silicon carbide, silicon nitride, aluminum nitride, or tungsten carbide-based compositions. Preferred compositions include a bimodal silicon carbide blend and those compositions disclosed in U.S. Pat. No. 5,045,237, the specification of which is incorporated by reference. Hot surface elements comprising a refractory metal element encased in a ceramic (as in U.S. Pat. No. 4,357,526) are also suitable for use with the present invention. The size and composition of the hot surface element should be selected to be suitable for use in at least part of the voltage range between about 3 and about 300 volts, and in at least part of the temperature range of between about 980° C. and about 1700° C. The one basic shape requirement is that the hot surface element have two ends for conducting an electric circuit. However, the shape can be any shape typically adopted in igniter geometries, including hairpins, coils, rods, serpentines and fibers. In some embodiments of the present invention having AlN-based compositions, the hot surface element has a hairpin design (as in FIG. 2), a height of between 1 cm and 8 cm, and a thickness of between 5 mm and 2.0 mm. In some embodiments having bimodal silicon carbide compositions, the hot surface element has a serpentine configuration (as in FIG. 4), a height of 5 to 10 cm, and a thickness of 2 to 13 mm.

In embodiments employing a high temperature lead wire to provide electrical connection between the metallized coatings of the igniter and the contacts of the socket, the high temperature lead wire has a melting point of at least 485° C., preferably at least 650° C. Generally, the high temperature lead wire is a metal or metal alloy. Materials suitable for use as the high temperature lead wire include nickel alloys, nickel, silver, gold, and platinum. Typically, the high temperature lead wire has a length of 1 cm to 15 cm, preferably 1 cm to 2 cm. Likewise, its diameter is typically between 0.5 and 1.5 mm.

The metallized coating covering the igniter ends can be any coating commonly used to electrically connect ceramic hot surface elements and lead wires. In some preferred embodiments, the metallized coating is a braze, preferably an active metal braze. When AlN-based hot surface elements are selected, the metallized coating is preferably a braze. In other preferred embodiments, the metallized coating is a flame spray coating, preferably comprising a nickel alloy. When bimodal silicon carbide-based hot surface elements are selected, the metallized coating is preferably a flame spray coating (although a braze can also be suitably used). With either of these coatings, the metallized coating is applied to the ends of the ceramic hot surface element in an amount sufficient to provide good electrical and physical connection between the ceramic hot surface element and the high temperature contacts or lead wires.

When a braze is used as the metallized coating, it is typically (but not exclusively) applied on one face of each end of the ceramic hot surface element, in regions of about 0.5 to 4 square millimeters ($mm^2$), by either brushing or silk-screening. To obtain the required high degree of adhesion to the ceramic, the braze typically contains an active metal which can wet and react with the ceramic materials and so provide adherence thereto by filler metals contained in the braze. Examples of specific active metals include titanium, zirconium and niobium. Preferably, the active metal is titanium or zirconium. In addition to the active metal, the braze typically contains one or more filler metals such as silver, copper, indium, tin, zinc, lead, cadmium, and phosphorous. Preferably, a mixture of filler metals is used. Most preferably, the braze will comprise titanium as the active metal and a mixture of copper and silver as the filler metal. Generally, the braze will contain between about 0.1 weight percent ("w/o") and about 5 w/o active metal, with the balance being filler metal. Suitable commercial brazes include Lucanex 721, available from Lucas Milhaupt, Inc. of Cudahy, Wis. and Cusil & Cusin Braze, available from Wesgo, Inc. of Belmont, Calif., each of which contains about 70.5 w/o silver, 27.5 w/o copper, and about 2 w/o titanium.

If a flame-sprayed coating is used, any conventional flame spray method can be employed for its delivery. The coating is typically resistant to degradation at temperatures of at least 485° C., preferably at least 650° C. Preferably, the flame-spray coating is a nickel alloy. It is typically applied in a thickness of between 0.1 and 0.3 mm.

In conventional systems, the region of the system around the NCC lead wire/metallized coating connection becomes unwieldy if the lead wire is too long (i.e., more than three inches). This problem is conventionally solved by encasing this region in a ceramic block. Since the present invention typically requires either a short lead wire or no lead wire at all, the reduced mass of the assembly could be adequate for maintaining stability without requiring the stabilizing ceramic block. Accordingly, another advantage of the present invention is the possible elimination of the ceramic block.

Figure 2:
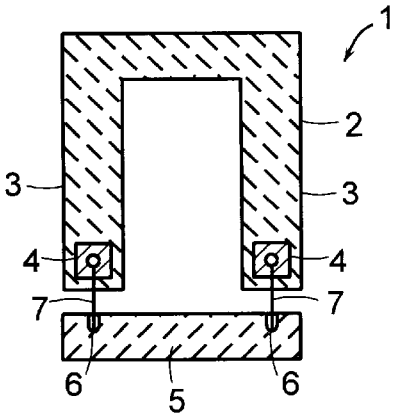
FIG. 2 is a drawing of the first preferred embodiment of the igniter system of the present invention.

Referring now to FIG. 2, there is provided in a first preferred embodiment of the present invention, a modular igniter system comprising:

a) a ceramic igniter 1 comprising:
   i) a ceramic hot surface element 2 comprising first and second ends 3, and
   ii) a metallized coating 4 covering at least a portion of each end of the ceramic hot surface element;

b) a socket 5 comprising first and second contacts 6 having a melting point of at least 485° C., and c) a pair of lead wires 7 having a length of less than 15 cm and a melting point of at least 485° C., wherein the lead wires electrically connect the metallized coatings 4 of the first and second ends 3 of the igniter 1 with the first and second contacts 6 of the socket 5, respectively.

In more preferred embodiments of the first preferred embodiment, the hot surface element comprises AlN, preferably a blend of AlN, SiC and $MoSi_2$. It typically has a height of 1–8 cm and a thickness of 0.5–2 cm. The metallized coating is preferably a braze which comprises silver, copper and titanium. The lead wires are preferably nickel and preferably have a length of less than 3 cm and a diameter of about 0.8 mm. The contacts are also preferably made of nickel and are shaped to receive the lead wire. More preferably, the contacts are shaped in the form of a tube having a depth of about 13 mm and a diameter of 1 mm.

Figure 3:
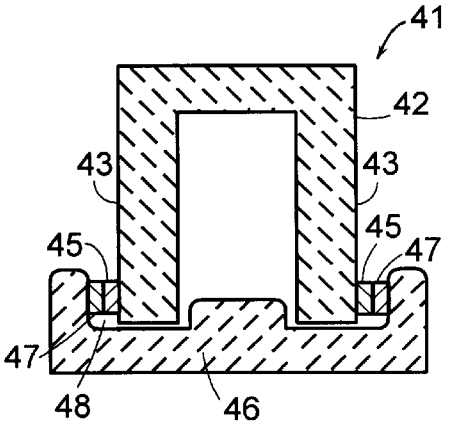
FIG. 3 is a drawing of the second preferred embodiment of the igniter system of the present invention.

Referring now to FIG. 3, there is provided in a second preferred embodiment of the present invention, a modular igniter system comprising:

a) a ceramic igniter 41 comprising:
   i) a ceramic hot surface element 42 having two ends 43, and
   ii) a metallized coating 45 covering at least a portion of the ends of the hot surface element 42, and b) a socket 46 having grooves 48 adapted to receive the ends 43 of the ceramic hot surface element 42, the socket comprising two contacts 47 positioned within the grooves for direct electrical connection to the metallized coatings 45, wherein the contacts 47 have a melting point of at least 485° C.

In more preferred embodiments of the second preferred embodiment, the hot surface element comprises AlN, preferably a blend of AlN, SiC and $MoSi_2$. It typically has a height of 1–8 cm and a thickness of 0.5–2 cm, and the cross-section of its ends are typically between 0.75 and 5 $mm^2$. The metallized coating is preferably a braze which comprises silver, copper and titanium. The contacts are preferably a Ni—Cr alloy shaped as pads having a surface area of between 0.3 and 3 $mm^2$and positioned on the inner surface of the groove.

Figure 4:
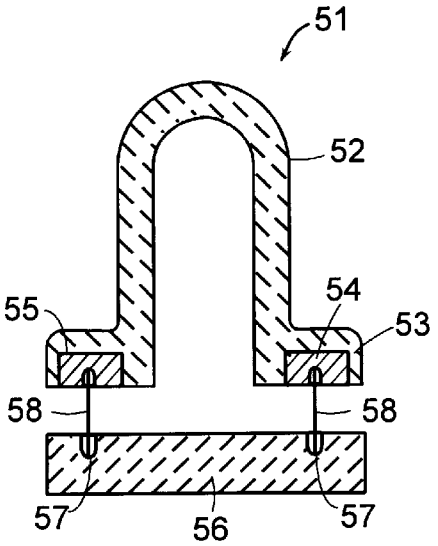
FIG. 4 is a drawing of the third preferred embodiment of the igniter system of the present invention.

Referring now to FIG. 4, there is provided in a third preferred embodiment of the present invention, a modular igniter system comprising:

a) a ceramic igniter 51 comprising:
   i) a ceramic hot surface element 52 comprising first and second ends 53, each end having a notch 54, and
   ii) a metallized coating 55 covering each end;

b) a socket 56 comprising first and second contacts 57, wherein the contacts have a melting point of at least 485° C.;

c) a pair of lead wires 58 having first and second ends, a length of less than 15 cm, and a melting point of at least 650° C.; and wherein the first ends of the lead wires are in electrical connection with the notched portion of the igniter ends, and the second ends of the lead wires are in direct electrical connection with the first and second contacts of the socket.

In more preferred embodiments of the third preferred embodiment, the lead wires are held in the notches by capping the first end of the lead wire with a Ni—Cr cap, bending the first end of the lead wire below the cap to form a hook, inserting the hook into the notch so that it is held in place by the spring tension of the hook, and flame spraying the assembly with a metallized coating to provide additional mechanical and electrical connection.

In especially preferred embodiments of the third preferred embodiment, the hot surface element comprises a bimodal blend of SiC. It preferably has a height of 5 to 8 cm, a thickness of 2–5 mm, and has ends whose cross-section is between 40 and 80 $mm^2$. The metallized coating is preferably a flame-sprayed Ni—Cr alloy. The lead wires are preferably a Ni—Cr alloy, and have a length of less than 3 cm inch and a diameter of about 0.8 mm. The contacts are preferably Ni—Cr receptors shaped in a tube form to receive the lead wire, the tube having a diameter of about 1 mm and a depth of between 10 mm and 20 mm.

Figure 5:
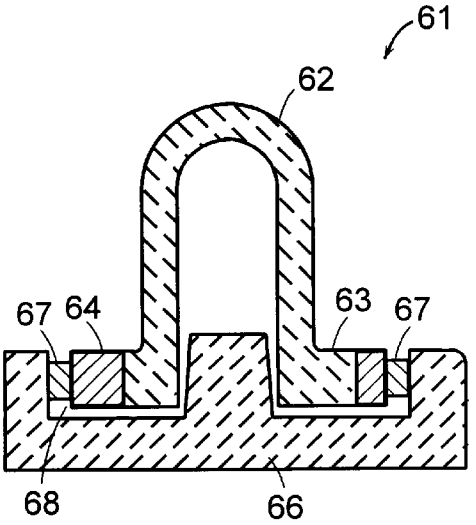
FIG. 5 is a drawing of the fourth preferred embodiment of the igniter system of the present invention.

Referring now to FIG. 5, there is provided in a fourth preferred embodiment of the present invention, a modular igniter system comprising:

a) a ceramic igniter 61 comprising:
   i) a ceramic hot surface element 62 comprising first and second ends 63, and
   ii) a metallized coating 64 covering at least a portion of the ends;

b) a socket 66 having grooves 68 adapted to receive the ends 63 of the ceramic hot surface element 62, the socket comprising two contacts 67 positioned for direct electrical connection to the metallized coating 64, wherein the contacts 67 have a melting point of at least 485° C.

In especially preferred embodiments of the fourth preferred embodiment, the hot surface element comprises a bimodal blend of SiC. It preferably has a height of 5 to 8 cm, a thickness of 2–5 mm, and has ends whose cross-section is between 40 and 80 $mm^2$. The metallized coating is preferably a flame sprayed Ni—Cr alloy. The contacts are preferably Ni—Cr pads having a surface area of between 10 $mm^2$ and 20 $mm^2$.

Solid-state circuitry may be designed into the socket to allow for an output voltage of between 5% and 95% of the nominal input voltage. In particular, a thyristor circuit (a device which switches on and off rapidly and in a controlled manner during each cycle of the applied alternating voltage so as to substantially provide to the igniter the effect of a lower voltage) can be incorporated into the socket, thereby eliminating the need for a step down transformer.

Also in accordance with the present invention, it has been found that the metallized coatings of the present invention can be provided through conventional Rf sputtering techniques to produce thin, multi-layered metallized coatings. A multi-layered metallized coating provides two advantages over conventional painted-on or silk-screened metallized coatings. First, whereas metallized coatings applied by conventional means have a thickness of at least 0.05 mm, Rf sputtered metallized coatings can have a thickness of only between 0.003 and 0.020 mm. The thinner metallized coating provides a lower stress resulting from the inevitable thermal expansion mismatch. Second, whereas the components of the conventional metallized coatings are applied en masse, the components of the Rf sputtered metallized coating may be applied in discrete layers. For example, a titanium layer may be applied to the ceramic hot surface element, a molybdenum layer may then be applied thereon, followed by a silver or nickel layer for connection to the high temperature metal contact. Since titanium bonds well to ceramics and silver maintains good electrical contact with the high temperature metal receptor, it is believed that the Rf sputtered metallized coating provides a more tailored thermal expansion response and hence allows for better management of residual stress at the ceramic-metal join.

Generally, the first layer of the Rf sputtered metallized coating can be any metal which bonds well to the ceramic hot surface element. These metals include titanium and zirconium. The first layer is typically applied in thickness of between about 1000 and 10000 angstroms. The second layer is typically a conductive layer and may include metals such as molybdenum, tungsten, tantalum and columbium. The second layer is typically applied in thickness of between about 2000 and about 20,000 angstroms. The third layer of the Rf sputtered metallized coating can be any metal which bonds well to the high temperature metal of the socket receptor. These metals include nickel, chromium, silver, gold, manganese, platinum and palladium. The third layer is typically applied in thickness of between about 10000 and about 100000 angstrom.

I claim:

1. A modular igniter system comprising:

a) a ceramic igniter comprising:

i) a ceramic hot surface element comprising first and second ends, and ii) a metallized coating which covers at least a portion of each end of the ceramic hot surface element;

b) a socket comprising i) first and second grooves, each groove shaped to receive only one end of the hot surface element, and ii) a contact positioned within each groove to produce electrical connection with the metallized coating of the end of the hot surface element to be received therein, wherein each end of the hot surface element is plugged into one of the grooves of the socket, thereby producing electrical connection between each metallized coating and its corresponding contact.

2. The system of claim 1 wherein two parallel grooves which extends into the socket, the the electrical connection between each metallized coating and its corresponding contact is direct electrical connection.

3. The system of claim 2 wherein each contact is a spring.

4. The system of claim 2 wherein the grooves contain pad-like high temperature contacts which are positioned on the sidewalls of the groove for direct electrical connection with the metallized coatings of the igniter.

5. The system of claim 1, wherein the grooves contain the tube-shaped contacts.

6. The system of claim 1 wherein each contact has a melting point of at least 485° C.

7. The system of claim 1 wherein the contacts are selected from the group consisting of a metal and a metal alloy.

8. The system of claim 1 wherein the contacts are selected from the group consisting of nickel alloys, nickel, gold, silver and platinum.

9. The system of claim 1 wherein the contacts are shaped as flat pads.

10. The system of claim 1 wherein the contacts are shaped as tubes.

11. The system of claim 1 wherein the ceramic hot surface element comprises one of silicon carbide, silicon nitride, aluminum nitride, or tungsten carbide.

12. The system of claim 11 wherein the ceramic hot surface element has a height of between 1 cm and 8 cm, and a thickness of between 0.5 mm and 2.0 mm.

13. The system of claim 1 wherein the ceramic hot surface element comprises a bimodal silicon carbide blend.

14. The system of claim 13 wherein the ceramic hot surface element has a height of 5 to 8 cm, and a thickness of 2 to 5 mm.

15. The system of claim 1 wherein the metallized coating is an active metal braze, and the system further comprises a high temperature lead wire electrically connecting the metallized coatings of the igniter and the contacts of the socket, and wherein the high temperature lead wire has a melting point of at least 485° C.

16. The system of claim 15 wherein the high temperature lead wire has a melting point of at least 650° C.

17. The system of claim 16 wherein the high temperature lead wire is selected from the group consisting of a metal or metal alloy.

18. The system of claim 16 wherein the high temperature lead wire is selected from the group consisting of nickel alloys, nickel, silver, gold, and platinum.

19. The system of claim 15 wherein the high temperature lead wire has a length of 1 cm to 15 cm.

20. The system of claim 15 wherein the high temperature lead wire is Ni—Cr.

21. The system of claim 20 wherein the high temperature lead wire has a diameter of between 0.5 and 1.5 mm.

22. The system of claim 1 wherein the metallized coating is an active metal braze.

23. The system of claim 1 wherein the metallized coating is a flame spray coating.

24. The system of claim 1 wherein the hot surface element comprises a blend of AlN, SiC and $MoSi_2$, has a height of 1–8 cm and a thickness of 0.5 to 2 cm.

25. The system of claim 1 wherein the metallized coatings comprise silver, copper and titanium.

26. The system of claim 1 wherein the cross-section of the ends of the hot surface element is between 0.75 and 5 $mm^2$.

27. The system of claim 1 wherein the contacts are pads having a surface area of between 0.3 and 3 $mm^2$.

28. The system of claim 1 wherein the hot surface element comprises a bimodal blend of SiC, has a height of 5 to 8 cm, a thickness of 2–5 mm, and has ends whose cross-section is between 40 and 80 $mm^2$.

29. The system of claim 1 wherein the metallized coating is a nickel alloy.

30. The system of claim 1 wherein the contacts are pads having a surface area of between 10 $mm^2$ and 20 $mm^2$.

31. A modular igniter system comprising:

a) a ceramic igniter comprising:

i) a ceramic hot surface element comprising first and second ends, and ii) a metallized coating comprising an active metal covering at least a portion of each end of the ceramic hot surface element;

b) a socket comprising first and second contacts having a melting point of at least 485° C.; and c) a pair of lead wires having a length of less than 15 cm and a melting point of at least 485° C., wherein the lead wires electrically connect the metallized coatings of the first and second ends of the igniter with the first and second contacts of the socket.

32. The system of claim 31 wherein the hot surface element comprises a blend of AlN, SiC and $MoSi_2$, has a height of 1–8 cm and a thickness of 0.5 to 2 cm.

33. The system of claim 32 wherein the metallized coating comprises silver, copper and titanium.

34. The system of claim 31 wherein the lead wires have a melting point of at least 650° C.

35. The system of claim 34 wherein the lead wires are nickel alloys.

36. The system of claim 31 wherein the lead wires have a length of less than 3 cm and a diameter of about 0.8 mm.

37. The system of claim 31 wherein the contacts have a melting point of at least 650° C.

38. The system of claim 31 wherein the contacts are nickel alloys.

39. The system of claim 31 wherein the contacts are shaped in the form of a tube having a depth of about 13 mm and a diameter of 1 mm.

* * * * *